US009355759B2

(12) United States Patent
Rivernider

(10) Patent No.: US 9,355,759 B2
(45) Date of Patent: May 31, 2016

(54) CATEGORY 8 CABLE

(71) Applicant: James F. Rivernider, Ware, MA (US)

(72) Inventor: James F. Rivernider, Ware, MA (US)

( * ) Notice: Subject to any disclaimer, the term of this patent is extended or adjusted under 35 U.S.C. 154(b) by 0 days.

(21) Appl. No.: 14/194,791

(22) Filed: Mar. 2, 2014

(65) Prior Publication Data

US 2014/0246219 A1 Sep. 4, 2014

Related U.S. Application Data

(60) Provisional application No. 61/771,667, filed on Mar. 1, 2013.

(51) Int. Cl.
*H01B 7/00* (2006.01)
*H01B 11/08* (2006.01)

(52) U.S. Cl.
CPC ..... *H01B 11/08* (2013.01)

(58) Field of Classification Search
USPC ..... 174/110 R, 113 R, 113 C, 115, 116, 174/120 R, 120 SR
See application file for complete search history.

(56) References Cited

U.S. PATENT DOCUMENTS

| | | | | |
|---|---|---|---|---|
| 3,911,200 | A * | 10/1975 | Simons et al. | 174/36 |
| 4,085,284 | A * | 4/1978 | Olszewski et al. | 174/36 |
| 4,773,976 | A * | 9/1988 | Vexler | 156/51 |
| 6,211,459 | B1 * | 4/2001 | O'Groske et al. | 174/36 |
| 6,288,340 | B1 * | 9/2001 | Arnould | 174/113 R |
| 6,462,268 | B1 * | 10/2002 | Hazy et al. | 174/36 |
| 6,566,606 | B1 * | 5/2003 | Hazy et al. | 174/113 R |
| 7,332,676 | B2 * | 2/2008 | Sparrowhawk | 174/102 R |
| 2001/0040042 | A1 * | 11/2001 | Stipes | 174/113 R |
| 2003/0111241 | A1 * | 6/2003 | Bahlmann et al. | 174/35 R |
| 2003/0121695 | A1 * | 7/2003 | Wiebelhaus et al. | 174/116 |
| 2004/0035603 | A1 * | 2/2004 | Clark et al. | 174/113 R |
| 2006/0048961 | A1 * | 3/2006 | Pfeiler et al. | 174/36 |
| 2007/0163800 | A1 * | 7/2007 | Clark et al. | 174/113 C |
| 2008/0105449 | A1 * | 5/2008 | Kenny et al. | 174/34 |
| 2009/0236121 | A1 * | 9/2009 | Hopkinson et al. | 174/113 R |
| 2011/0048767 | A1 * | 3/2011 | Johnston et al. | 174/116 |

FOREIGN PATENT DOCUMENTS

| | | | | |
|---|---|---|---|---|
| DE | 29719866 U | * | 2/1998 | H01B 11/06 |

* cited by examiner

*Primary Examiner* — William H Mayo, III
(74) *Attorney, Agent, or Firm* — Gerry A. Blodgett; David J. Blodgett; Blodgett & Blodgett, P.C.

(57) ABSTRACT

A high speed Ethernet cable constructed of two groups of two twisted wire pairs each. The two groups radiationally isolated from each other by one or more foil radiation shields.

20 Claims, 2 Drawing Sheets

CATEGORY 8 CABLE

CROSS-REFERENCE TO RELATED APPLICATIONS

This application claims the benefit under 35 U.S.C. section 119(e) of U.S. Provisional patent application No. 61/771,667 filed Mar. 1, 2013 which is hereby incorporated by reference.

STATEMENT REGARDING FEDERALLY SPONSORED RESEARCH OR DEVELOPMENT

This invention has been created without the sponsorship or funding of any federally sponsored research or development program.

THE NAMES OF THE PARTIES TO A JOINT RESEARCH AGREEMENT

Not Applicable.

INCORPORATION-BY-REFERENCE OF MATERIAL SUBMITTED ON A COMPACT DISC OR AS A TEXT FILE VIA THE OFFICE ELECTRONIC FILING SYSTEM (EFS-WEB)

Not Applicable.

STATEMENT REGARDING PRIOR DISCLOSURES BY THE INVENTOR OR A JOINT INVENTOR

Not Applicable.

BACKGROUND OF THE INVENTION

A current challenge to cable manufacturers is to produce a cable that avoids "spikes" in Near End Crosstalk (NEXT) and Far end Crosstalk (FEXT) at transmission frequencies up to 2 Ghz. Crosstalk is the result of radiational coupling between twisted wire pairs situated in close proximity to each other. A situation that must be minimized in digital transmission cables. It is believed that repetitions in the cable lays (occurring naturally or resulting from manufacturing defects) cause coupling to add constructively, resulting in "spikes" in near end and/or farend crosstalk at certain frequencies.

In a current four pair cable using Unshielded Twisted Pair (UTP) or using Foil Shielded Twisted Pair (F/UTP) there are 6 combinations of possible twisted pair/twisted pair radiational interaction: (1) pair one to pair two, (2) pair one to pair three, (3) pair one to pair four, (4) pair two to pair three, (5) pair two to pair four) and (6) pair three to pair four. These combinations must be constructed with the spacing of repetitions or defects being outside the desired frequency range of the cable. The spacing of repetitions or defects must be greater than half the wavelength of the highest frequency of interest. Finding a suitable spacing of repetitions or defects is difficult when the frequency range is more than 500 Mhz because the shorter wavelength makes for fewer possible lay combinations that do not repeat in the given frequency range.

One solution is to shield all four twisted wire pair to eliminate coupling. The drawback of this solution is the increased size of the cable and the increased size of the twisted wire pairs themselves. In order to produce an individually shielded twisted wire pair with the required impedance, the insulation thickness of the wire must be significantly greater than that which is necessary for an unshielded twisted wire pair cable having the same impedance. This increases the overall cost, size, and stiffness of the cable.

Another solution is to increase the size or thickness of a separator or filler used to assure an appropriate distance is maintained between the twisted wire pairs. However, this method also increases the overall size and stiffness of the cable.

A further solution is for the manufacturer to intentionally vary the twisted wire pair lays during the cable construction. This method, however, complicates the manufacturing operation, making the setup more difficult and increasing the chance of errors during the setup and construction of the cable.

The applicant's proposed design requires only one or two twisted wire pair combinations because a radiation shield isolates the twisted wire pairs into two groups of two twisted wire pairs each. The applicant's unique method of applying the radiation shield eliminates from consideration four (or possibly five) of the theoretical radiationally significant twisted wire pair interactions. The only interactions required to consider are (1) and (6) from the list of possible combinations noted above. In other words, the combination options are reduced to: twisted wire pair one combined with twisted wire pair two and separately, twisted wire pair three combined with twisted wire pair four.

It is, furthermore, possible that the particular lay combination of twisted wire pair one to twisted wire pair two can be used in the construction of both groups of twisted wire pairs without this causing NEXT and FEXT spike issues. The applicant's unique method of applying the radiation shield also reduces the need to increase the insulation thickness in order to achieve the desired impedance because the shield is applied in a relatively loose manner around the twisted wire pair groups.

BRIEF SUMMARY OF THE INVENTION

This category 8 cable is meant for use in high speed Ethernet applications having up to a 40 Gbit/sec data rate, with a frequency range of the cable extending to at least 2 GHz. Performance parameters for this cable are expected to extend to at least 2 Ghz. This includes near end crosstalk parameters.

DETAILED DESCRIPTION OF THE INVENTION

Figure 1:
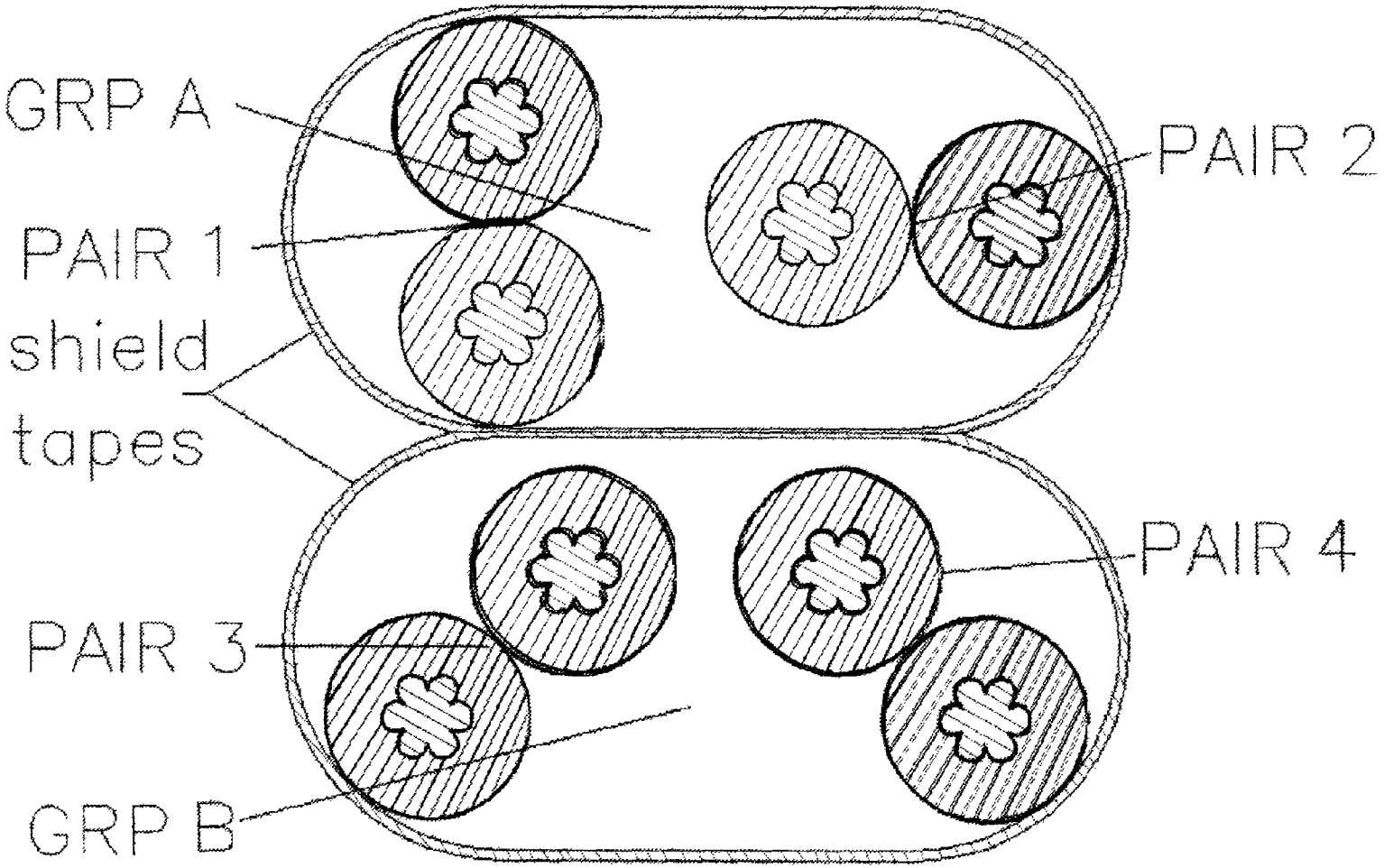
FIG. 1 is a cross-section of a first arrangement of the shield on the wire.

One embodiment of the instant invention as shown in FIG. 1 is a Category 8 Cable consisting of two wire groups, A and B, with two twisted wire pairs in each group, pair 1 and 2 in group A, and pair 3 and 4 in group B. Each individual wire, of the twisted wire pairs, is insulated with a solid or foamed polymer (for example: HDPE). The cable core, consisting of the two wire groups, A and B, is wrapped with at least one shield tape in an "S" arrangement as shown in FIG. 1. The single shield tape wraps around each group and passes between them. A standard PVC cable jacket, not shown in the FIG. 1 or 2, surrounds the entire core.

Alternatively, in another embodiment a second shield tape surrounds the first shield tape and both wire groups.

Figure 2:
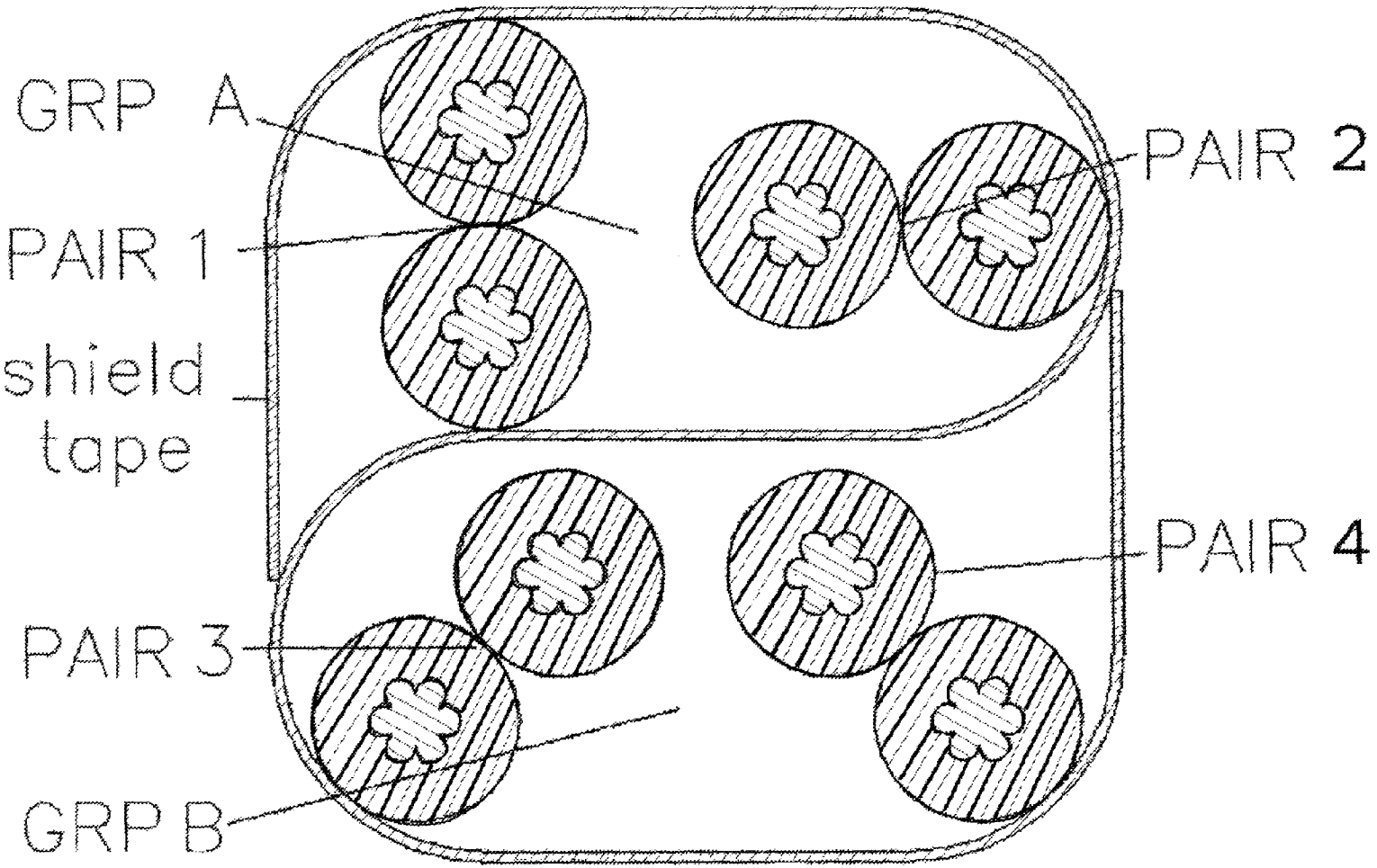
FIG. 2 is a cross-section of a second arrangement of the shield on the wire.

As shown in FIG. 2, another embodiment of the invention employs two separate foil shield tapes, each surrounding one of the two wire groups, A and B, making up the cable core. This alternative construction provides two layers of foil shield tape between the two wire groups A and B.

Each wire group A and B consists of two twisted pairs 1-4, the lay of each individual twisted pair in a group being different from the other in the same group. Furthermore, each lay is calibrated in such a way as to minimize radiational interference between the two twisted pairs in a group. Coupling interference between the two groups A and B is minimized by the foil shield tape, making it possible for the lays in group A to be identical to the lays in group B without an increase in radiational interference.

The lays in group A can alternatively be different from the lays in group B provided that lay combinations within each group are chosen so as to minimize the susceptibility of constructive addition between the proximate twisted wire pairs. Because of the foil shield tape, negative interactions between group A and group B are eliminated.

In a further embodiment, a foil shield tape surrounds group A while another foil shield tape surrounds both group A and B simultaneously. And, in a still further embodiment, a foil shield tape surrounds group A while another shield forms an integral part of the outer jacket that surrounds both group A and B.

The invention claimed is:

1. A cable meant for high speed Ethernet applications for 40 Gbit/sec data rates, so that the frequency range of the cable is expected to be at least 2 Ghz, comprising:

a. a core, comprising:

a-i. a first group of two pairs of insulated wire, comprising a first insulated wire pair and a second insulated wire pair, the first wire pair having a different lay from the second wire pair such that radiational interference between the first and second wire pairs is minimized, b-ii. a second group of two pairs of insulated wire, comprising a first insulated wire pair and a second insulated wire pair, the first wire pair having a different lay from the second wire pair such that radiational interference between the first and second wire pairs is minimized, c-iii. An electrically conductive radiation shield that radiationally isolates the first group, from the second group, but does not radiationally isolate the first insulated wire pair within a particular group from the second insulated wire pair in that same group, and b. an outer jacket surrounding the core.

2. A cable as recited in claim 1, wherein the electrically conductive radiation shield consists of two independent zones, a first electrically conductive radiation shield zone that surrounds the first group, but not the second group, and a second electrically conductive radiation shield zone that surrounds the second group, but not the first group, and which does not isolate the first insulated wire pair within the second group from the second insulated wire pair in that same group.

3. A cable as recited in claim 2, wherein at least one of the electrically conductive radiation shield zones is a metal shield.

4. A cable as recited in claim 2, wherein at least one of the electrically conductive radiation shield zones is a grounded metal shield.

5. A cable as recited in claim 2, wherein at least one of the electrically conductive radiation shield zones is a foil shield.

6. A cable as recited in claim 2, wherein at least one of the electrically conductive radiation shield zones is a metal foil shield.

7. A cable as recited in claim 1, wherein the electrically conductive radiation shield consists of two independent zones, a first electrically conductive radiation shield zone that surrounds the first group, but not the second group, and a second electrically conductive radiational shield zone which surrounds the core and which is integral to the construction of the outer jacket surrounding the core.

8. A cable as recited in claim 7, wherein at least one of the electrically conductive radiation shield zones is a metal shield.

9. A cable as recited in claim 7, wherein at least one of the electrically conductive radiation shield zones is a grounded metal shield.

10. A cable as recited in claim 7, wherein at least one of the electrically conductive radiation shield zones is a foil shield.

11. A cable as recited in claim 1, wherein both the first group and the second group of twisted wire pairs are surrounded by a further electrically conductive radiation shield which radiationally isolates both the first group and the second group from the surrounding environment.

12. A cable as recited in claim 1, wherein the electrically conductive radiation shield is a metal shield.

13. A cable as recited in claim 1, wherein the electrically conductive radiation shield is a grounded metal shield.

14. A cable as recited in claim 1, wherein the electrically conductive radiation shield is a foil shield.

15. A cable as recited in claim 1, wherein the electrically conductive radiation shield is a metal foil shield.

16. A cable as recited in claim 1, wherein the electrically conductive radiation shield has one continuous cross-section and surrounds the first group and the second group, and radiationally isolates the first group from the second group.

17. A cable as recited in claim 1, wherein the electrically conductive radiation shield has one continuous cross-section, surrounds the first group and the second group, radiationally isolates the first group from the second group, and is in a form having an S-shaped cross-section with a first loop around the first group and a second loop around the second group.

18. A cable as recited in claim 1, wherein the electrically conductive radiation shield has one continuous cross-section, surrounds the first group and the second group, radiationally isolates the first group from the second group, and is in a form having an S-shaped cross-section, with a first loop having a first free end and with the first loop surrounding the first group, a second loop having a second free end with the second loop surrounding the second group, and the electrically conductive radiation shield having an intermediate section with the free ends of each of the loops conductively connected to the intermediate section.

19. A cable as recited in claim 1, wherein the electrically conductive radiation shield is in a form having an S-shaped cross-section with a first loop around the first group, a second loop around the second group, each loop having a free end, and an intermediate section, having a portion nearer to the free end of the first loop and a portion nearer to the free end of the second loop, and the free ends of each of the loops are electrically conductively connected to the intermediate section, so that the free end of the first loop is electrically conductively connected to the second portion, and the free end of the second loop is electrically conductively connected to the first portion.

20. A cable meant for high speed Ethernet applications for 40 Gbit/sec data rates, so that the frequency range of the cable is expected to be at least 2 Ghz, comprising:

a. a core, comprising:

a-i. a first group of two pairs of insulated wire, comprising a first insulated wire pair and a second insulated wire pair, the first wire pair having a different lay from the second wire pair such that radiational interference between the first and second wire pairs is minimized, b-ii. a second group of two pairs of insulated wire, comprising a first insulated wire pair and a second insulated wire pair, the first wire pair having a different lay from the second wire pair such that radiational interference between the first and second wire pairs is minimized, c-iii. An electrically conductive radiation shield that radiationally isolates the first group, from the second group, but does not radiationally isolate the first insulated wire pair within a particular group from the second insulated wire pair in that same group, d-iv. the electrically conductive radiation shield being in a form having an S-shaped cross-section with a first loop around the first group, a second loop around the second group, each loop having a free end, and an intermediate section, having a portion nearer to the free end of the first loop and a portion nearer to the free end of the second loop, and the free ends of each of the loops are electrically conductively connected to the intermediate section, so that the free end of the first loop is electrically conductively connected to the second portion, and the free end of the second loop is electrically conductively connected to the first portion, b. an outer jacket surrounding the core.

* * * * *